US006854926B2

(12) United States Patent
Siglin et al.

(10) Patent No.: US 6,854,926 B2
(45) Date of Patent: Feb. 15, 2005

(54) ZERO GROUND DISTURBANCE SYSTEM

(75) Inventors: Donald J. Siglin, Oro Valley, AZ (US); David A. Ver Steeg, Sioux Falls, SD (US); Charles L. Hammond, Sioux Falls, SD (US); Gary D. Seeba, Sioux Falls, SD (US); Keith M. Polzin, Tea, SD (US); Gary L. Hoover, Sioux Falls, SD (US)

(73) Assignee: Sioux Steel Company, Sioux Falls, SD (US)

( * ) Notice: Subject to any disclaimer, the term of this patent is extended or adjusted under 35 U.S.C. 154(b) by 0 days.

(21) Appl. No.: 10/723,853

(22) Filed: Nov. 26, 2003

(65) Prior Publication Data

US 2004/0120769 A1 Jun. 24, 2004

Related U.S. Application Data

(60) Provisional application No. 60/430,589, filed on Dec. 2, 2002.

(51) Int. Cl.[7] ..... E02B 7/20
(52) U.S. Cl. ..... 405/52; 405/114
(58) Field of Search ..... 405/52, 53, 107, 405/114, 115, 129.45, 129.55, 129.57, 303

(56) References Cited

U.S. PATENT DOCUMENTS 4,765,775 A * 8/1988 Kroger ..... 405/52
4,802,322 A * 2/1989 Bendfeld ..... 405/52
5,356,119 A * 10/1994 Schock ..... 256/26
5,689,920 A * 11/1997 Hallsten ..... 405/114
5,779,227 A * 7/1998 Elkins et al. ..... 256/31
5,800,091 A * 9/1998 Van Romer ..... 405/52
5,810,511 A * 9/1998 Schmidt ..... 405/52
5,882,142 A 3/1999 Siglin et al.
6,695,534 B2 * 2/2004 Cain et al. ..... 405/114

OTHER PUBLICATIONS

"Containment Systems", brochure by Sioux Steel Company, Inc. date unknown.
"Brock Containment Systems", brochure by Brock Industrial Systems, date unknown.

* cited by examiner

*Primary Examiner*—Frederick L. Lagman
(74) *Attorney, Agent, or Firm*—McAndrews, Held & Malloy, Ltd.

(57) ABSTRACT

A zero ground disturbance dike apparatus and method for the secondary containment of harmful chemicals that are stored in primary storage vessels, wherein the dike apparatus does not require the drilling of postholes or the setting of support posts in concrete. Sections of dike walls are attached to bracing assemblies, each bracing assembly being comprised of a brace and a base plate. Braces are configured to support the assembled wall sections and to provide resistance against the outwardly force exerted by material that is released from the primary storage vessel. Base plates attached to the braces assist in resisting bending moments that may be created about the base of the dike apparatus. The brace assembly also preferably includes at least one base support channel for additional base plate stiffness and support cables to further resist the outwardly forces exerted against the dike apparatus by said released materials.

23 Claims, 7 Drawing Sheets

ZERO GROUND DISTURBANCE SYSTEM

RELATED APPLICATIONS

This application claims the benefit of U.S. Provisional Application No. 60/430,589, filed Dec. 2, 2002, which is incorporated herein by reference in its entirety.

BACKGROUND OF THE INVENTION

The present invention pertains to the secondary containment of stored chemicals that are harmful to both the environment and living creatures. More particularly, the present invention relates to a zero ground disturbance dike apparatus for the secondary containment of stored harmful materials that does not require the drilling of postholes or the setting of support posts in concrete.

The storage of hazardous materials, such as petroleum contaminated process-water, industrial chemicals, liquid agricultural chemicals, and other corrosive chemicals in storage tanks are well known. Such tanks are designed and fabricated to prevent the uncontrolled release of these and other hazardous materials into the environment so as to reduce the risks associated with the pollution of the surrounding area and/or potential contamination of nearby ground water.

However, storage tanks have been known to occasionally accidentally leak or spill the entrapped hazardous material. In an attempt to minimize the potential harmful effects of such a leakage or spill, containment systems are often designed to incorporate both a primary storage containment vessel, such as a storage tank, and a secondary containment system. One form of secondary containment system that is often used with above ground containment systems is a dike apparatus.

In the past, dike apparatuses have been constructed from a variety of materials. Most dike apparatuses have been fabricated from earth, wood, and concrete. These apparatuses are often virtually permanent in both size and location. However, the construction of dike apparatuses from such materials, and their intended permanency, typically makes any attempt to subsequently expand these apparatus both labor intensive and expensive. Furthermore, when removed or vacated, such apparatuses often leave an indelible mark on the surrounding surface.

Dike apparatuses fabricated from metal are also well known in the art. These systems are often pre-fabricated before being transported to storage facilities for on-site assembly. The metallic walls of such apparatuses are typically bolted to support posts, with the support posts being secured into the surrounding ground. However, the metallic surfaces of these systems often prevent such dikes from being used in conjunction with the storage of materials that are highly reactive to metals, such as liquid fertilizers. Furthermore, the reliance on support posts that are secured-beneath the surrounding ground subjects these systems to damage related to frost heavage. Differential frost heavage typically results in the displacement of the support posts, and their attached wall sections, thus pulling the wall sections away from one another, and thereby potentially compromising the dike's seal of containment. The need to fix this reoccurring separation between the wall sections so as to maintain the integrity of the dike apparatus typically makes these systems costly to maintain.

U.S. Pat. No. 5,882,142 ("'142") discloses a metal dike system that is designed to prevent damage due to frost heavage. The apparatus disclosed in U.S. Pat. No. '142 includes a plurality of wall sections that are attached to support posts, the support posts being secured in concrete that is located below the frost line. The support posts, which are preferably six to twelve feet long, include elongated apertures that receive the insertion of bolts that attach sections of the steel dike walls to the support posts. The elongation of the apertures is configured to permit the movement of the bolts along the apertures, thereby allowing the steel walls and support posts to move separately of each other in response to post displacement that is caused by differential frost heavage. Additionally, the steel walls are bolted to adjacent wall sections in an end-to-end arrangement so that, in instances of frost heavage, the movement of the posts will not affect the connection between the walls, and thereby prevent the dike seal from being compromised.

However, in order to secure support posts in concrete that is located below the frost line, as required by invention disclosed in U.S. Pat. No. '142, postholes must be drilled into the surrounding ground. In order to extend below the frost line, these postholes often have to be drilled up to depths of eight feet. Drilling to such depths can be both expensive and labor intensive, particularly in light of the fact that site conditions throughout the world vary greatly. For instance, in some areas, the presence of limestone or other rock strata makes drilling postholes very difficult and expensive. In other areas of the world, or during winter months, frozen ground increases the difficultly and expense of installation. Drilling to depths of up to eight feet also creates additional potential hazards, including the dangers associated with the drill hitting underground gas lines, electrical lines, and/or pipes. Furthermore, in some countries, such as Canada, local regulations prohibit ground penetrations of more than twelve inches on public lands. Additionally, because such storage facilities are often located in remote areas, transporting cement to set the support posts in the postholes, as required by the '142 patent, is expensive.

It is therefore an object of the present invention to provide an apparatus for the secondary containment of hazardous materials that may be accidentally released from a primary storage vessel.

It is a further object of the present invention to provide a zero ground disturbance system for the secondary containment of hazardous materials.

It is another object of the present invention to provide a secondary containment system that does not require the drilling of postholes for support posts.

A further object of the present invention is to provide a secondary containment system to control the accidental leakage or spillage of hazardous materials from a primary containment system that does not require the setting of support posts in concrete.

It is also on object of the present invention to provide a secondary containment system that complies with local regulations regarding limitations on ground penetration.

These and other desirable characteristics of the present invention will become apparent in view of the present specification, including the claims and drawings.

BRIEF SUMMARY OF THE INVENTION

The present invention is directed towards a method and apparatus for the secondary containment of hazardous materials. Specifically, the present invention relates to a zero ground disturbance dike apparatus for the secondary containment of harmful materials that are stored in a primary storage vessel, wherein the dike apparatus does not require the drilling of postholes or the setting of support posts in concrete.

The dike apparatus of the illustrated embodiment is comprised of wall sections that are operably attached to brace assemblies. Each wall section preferably boltingly engages an adjacent wall section in an overlapping end-to-end arrangement, the attachment of the wall sections being oriented to form a dike apparatus inner chamber, the region encapsulated within the inner chamber preferably extending down to at least to the adjacent ground. A seal between each wall section is also preferably created by the placement of a seam sealant to the outer edge of each vertical seam that is formed by said overlapping engagement of the wall sections.

Each brace assembly is preferably comprised of a brace and a base plate. In the illustrated embodiment, the braces preferably have a body portion, a stiffening plate, an upper flange, and a lower flange. The braces are configured to provide vertical support to the walls and, in the event that materials are leaked or spilled from the primary storage vessel, assist in withstanding the resulting outwardly forces that may be exerted on said walls by the released materials while also maintaining minimal wall deflection. The braces are also preferably attached to a wall section or sections via the bolting of the upper flange to the adjacent wall section (s).

The base plate is configured to resist the bending moment that is created at the base of the dike apparatus when materials released from the primary storage vessel exert an outwardly force against the attached wall sections. The base plates in the illustrated embodiment are comprised of an upper surface, a bottom surface, a proximate end, a distal end, and side extensions, and are preferably generally rectangular in shape. At least a portion of the upper surface preferably boltingly engages the lower flange of the brace, thereby securing the brace to the base plate.

In the illustrated embodiment, the base plate is positioned so that a substantial portion of the proximate end extends within the region defined by the inner chamber, as illustrated in FIGS. 3, 4, 7, 8, and 9. This configuration allows the base plate to use the weight of both the released materials from the primary storage vessel and the components of the containment system that are located above that portion of the base plate that is within the inner chamber to resist the bending moment created at the base of the dike apparatus, thereby preventing the base plate and attached brace and walls from tipping over in a generally outwardly direction.

The side extensions are configured to provide traction for the base plate. When subjected to the weight of said released materials and the dike apparatus, the lower portion of the side extensions aid in gripping the surrounding ground so as to resist any lateral movement caused by the outwardly forces that are exerted by the spilled or leaked material against the walls of the dike apparatus.

The illustrated embodiment of the present invention also preferably includes at least one base support channel that is operably connected to the base plate. The base support channel is configured to provide additional stiffness to the base plate so as to provide additional resistance against any bending moment that may be created at the base of the dike apparatus. In an attempt to not compromise the stability of the brace assembly, the base support channel is preferably recessed into the base plate, whereby the base support channel attaches to the bottom surface of the base plate and does not extend beyond the lower portion of the side extensions or the proximate or distal ends of said base plate. Alternatively, the base plate channel may be constructed to provide sufficient stiffniess so as to eliminate the need for a brace support channel.

To further prevent the lateral movement of the walls when the walls of the dike apparatus are subjected to the outwardly forces created by the release of material from primary storage vessel, the dike apparatus of the present invention also preferably includes at least one support cable. The support cable preferably has a first end and a second end, the first end being secured to a first brace assembly and the second end being secured to a second brace assembly, the first and second brace assemblies preferably being located across from one another on opposing walls. When secured to the brace assemblies, the support cable extending across the inner chamber is preferably maintained in a taut condition so as to assist in resisting any outwardly forces that may be exerted against said walls and the brace assemblies.

BRIEF DESCRIPTION OF SEVERAL VIEWS OF THE DRAWINGS

For a more complete understanding of this invention reference should now be had to the embodiment illustrated in greater detail in the accompanying drawings and described below by way of example of the invention.

DETAILED DESCRIPTION OF THE INVENTION

Figure 1:
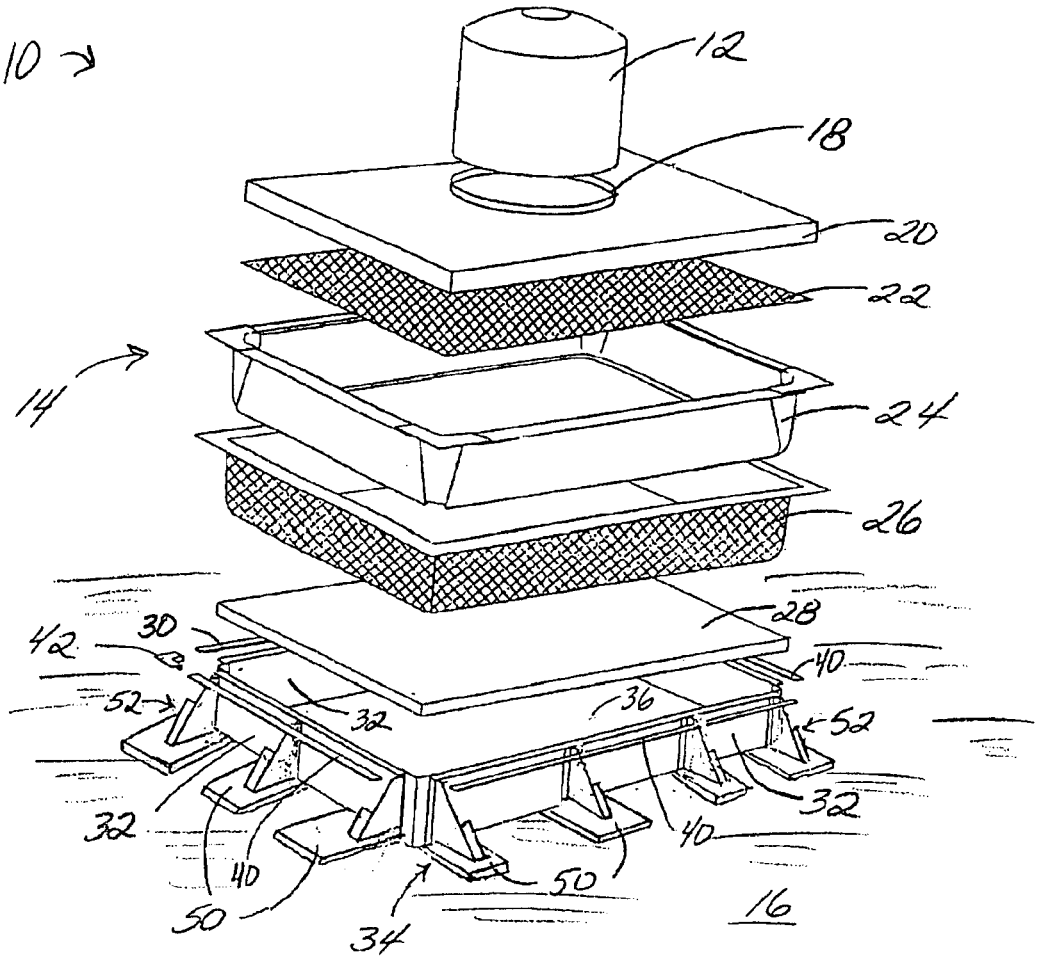
FIG. 1 is an exploded view of a containment system that employs a dike apparatus in accordance with the illustrated embodiment of the present invention.

FIG. 1 illustrates a containment system 10 in accordance with the illustrated embodiment of the present invention. The containment system 10 is comprised of a primary storage vessel 12, such as a storage tank, that is configured to hold hazardous materials, and a secondary containment system in the form of a dike apparatus 14. The dike apparatus 14 is comprised of a plurality of brace assemblies 34 set upon the ground 16. The plurality of brace assemblies 34 provide support to a plurality of wall sections 32, at least a portion of the plurality of wall sections 32 preferably being bolted to at least a portion of an adjacent brace assembly 34.

Figure 8:
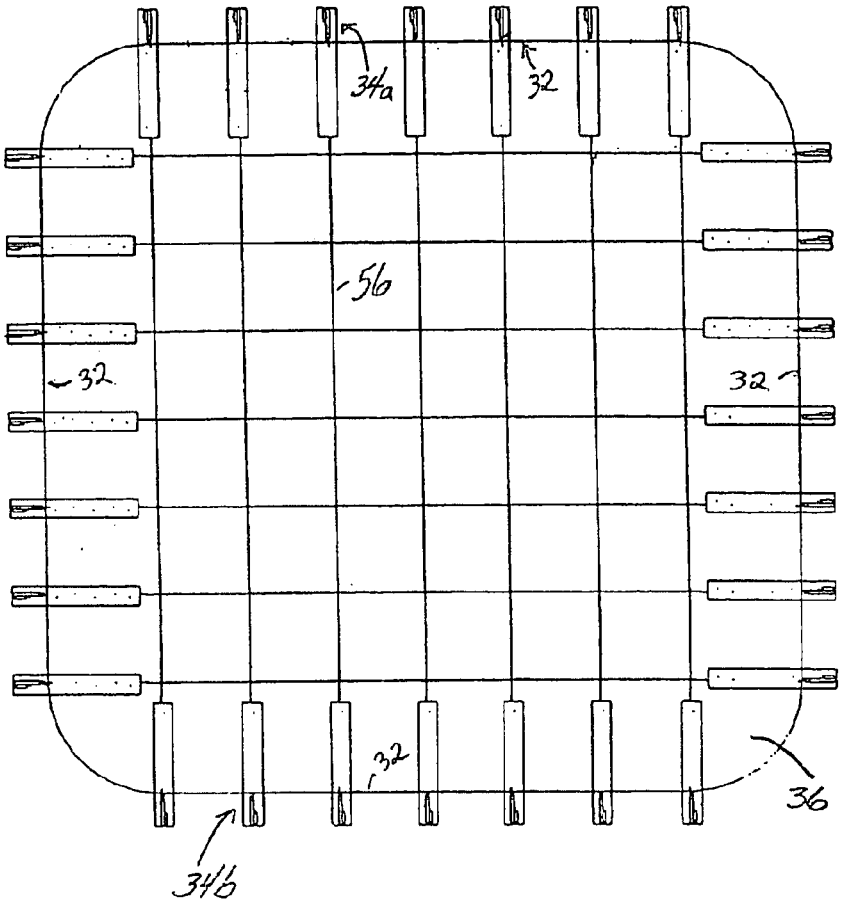
FIG. 8 is a top view of a portion of a rectangular dike apparatus in accordance with an illustrated embodiment of the present invention.
Figure 9:
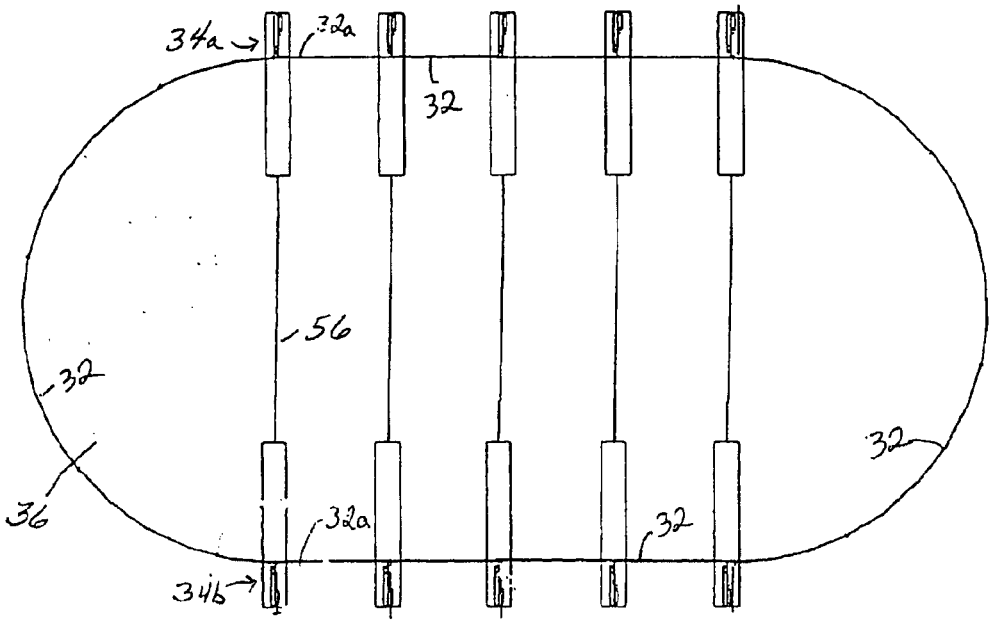
FIG. 9 is a top view of a portion of an oblong dike apparatus in accordance with an illustrated embodiment of the present invention.

The wall sections 32 and attached brace assemblies 34 are arranged to create an enclosed inner chamber 36, as illustrated in FIGS. 1, 8, and 9. The region encapsulated within the inner chamber 36 extends down to at least the enclosed ground 16. The plurality of brace assemblies 34 are also preferably positioned along the plurality of wall sections 32 so as to equally distributed the forces that are, or, in the event of a spill or leak, may be asserted against the wall sections 32.

The dike apparatus 14 also includes a dike base cover 28. The dike base cover 28 in the illustrated embodiment of the present invention is a layer of sand that is preferably approximately two inches deep. Ground 16 conditions beneath the dike base cover 28 are preferably stable and suitable for the fluid loads that are placed upon the walls of the primary storage vessel 12 and those that may be placed upon the wall sections 32 of the dike apparatus 14 in the event of the leakage or spilling of said hazardous materials. Furthermore, the ground 16 under and around the containment system 10 is also preferably undisturbed or re-compacted and sufficiently level. The ground 16 adjacent to the containment system 10 also preferably provides sufficient drainage to prevent soil erosion around the containment system 10.

Above the dike base cover 28 is a pad 26, the pad 26 being preferably made from at least eight-ounce geotextile fabric. The pad 26 is configured to enwrap a liner 24, and, along with the liner 24, is inserted into at least a portion of the inner chamber 36. The liner 24 is constructed of material that prevents the passage therethrough of said leaked or spilled materials from the primary storage vessel 12.

The liner 24 and pad 26 are both preferably attached to at least a portion of the wall sections 32. In the illustrated embodiment, the liner 24 and pad 26 are secured to the top portion of the plurality of wall sections 32 through the use of clamps 40 and corner clamp assemblies 42. Furthermore, in the illustrated embodiment, the upper edge of the wall sections 32 are flanged so as to provide a surface upon which the liner 24 and pad 26 are pulled over and to which the clamps 40, 42 may secure the liner 24 and pad 26 to the wall 32. The clamps 40 preferably have a V-shape, the V-shape having upper and lower legs. In such an arrangement, at least a portion of the top of the liner 24 and pad 26 are placed between the flanged upper portion of the wall 32 and the inner surface the upper leg of the V-shaped clamp 40. The inner portion of the lower leg of the V-shaped clamp 40 is positioned against at least a portion of the bottom of the flanged upper portion of the wall 32. Bolts and/or screws are inserted through the clamps 40, liner 24, pad 26, and upper flanged portion of the wall sections 32 so as to tighten the compressing force of the clamps 40 on the liner 24, pad 26, and flanged portion of the wall 32. The clamps are preferably elongated to decrease the ability of the liner 24 and pad 26 to pull away from the inserted bolts and/or screws.

Figure 10:
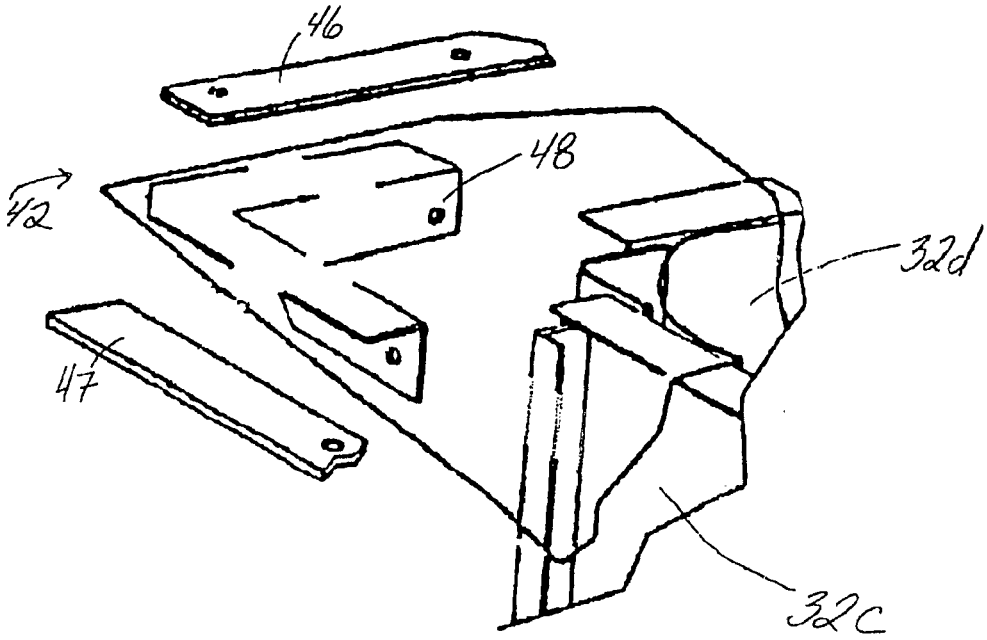
FIG. 10 illustrates an exploded view of a corner bracket for a dike apparatus in accordance with one embodiment of the present invention.

Corner clamp assemblies 42 for rectangular or square shaped dike apparatuses 14 are preferably comprised of upper and lower brackets 46, 47 and a corner clamp 48 that joins intersecting wall sections 32*c*, 32*d*, as illustrated in FIG. 10. In operation, the upper bracket 46 is positioned against the liner 24, while the lower bracket 47 is placed against the bottom of the flanged upper portion of the respective wall 32*c*, 32*d*. Bolts and/or screws are inserted through the brackets 46, 47, corner clamp 48, liner 24, pad 26, and upper flanged portion of the wall 32 to create the desired clamping force.

A second pad 22 is placed along at least a portion of the base of the liner 24. This second pad 22 is preferably constructed from eight-ounce geotextile fabric, but may also be an approximately two inch deep layer of sand. Above the second pad 22, and within the inner boundaries of the liner 24, is a layer of pea gravel 20 that is configured to support the primary storage vessel 12. In the illustrated embodiment, the layer of pea gravel 20 is approximately six inches deep. To further assist in containing any leakage or spill from the primary storage vessel 12, a gravel ring 18 is preferably positioned on top of the layer of pea gravel 20 and around the base of the primary storage vessel 12.

Figure 2:
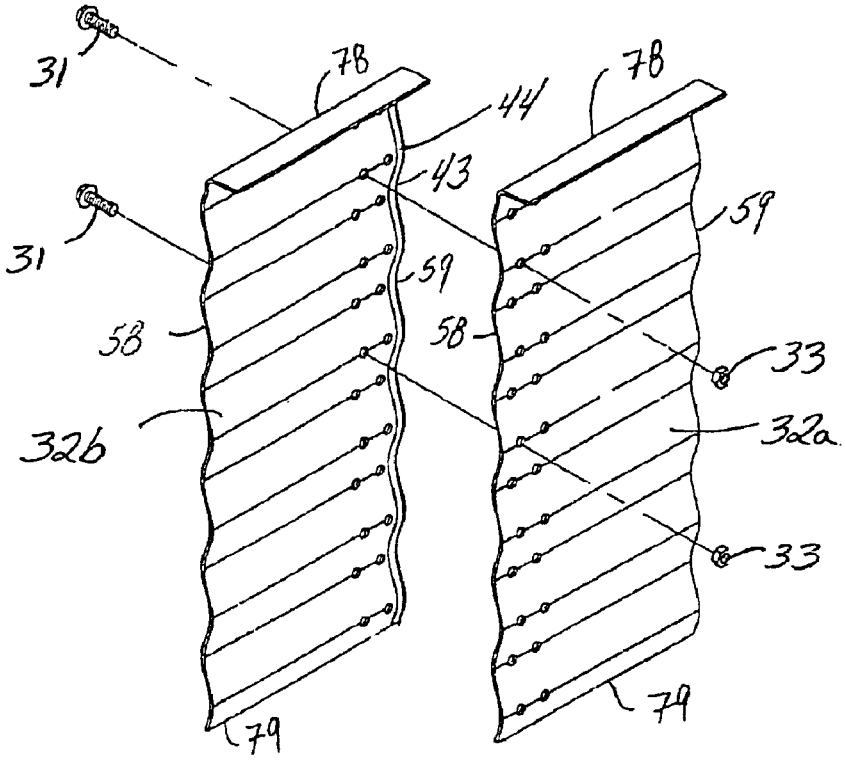
FIG. 2 is an exploded view of two adjacent wall sections in accordance with the illustrated embodiment of the present invention.

FIG. 2 illustrates the attachment of two adjacent sections of dike wall sections 32*a*, 32*b* in accordance with the illustrated embodiment of the present invention. In the illustrated embodiment, the first and second vertical ends 58, 59 of the wall sections 32*a*, 32*b* are generally parallel to one another while the horizontal edges 78, 79 are generally parallel to each other. As shown, the adjacent wall sections 32*a*, 32*b* that form each individual wall of the inner chamber 36 of the dike apparatus 14 are arranged in an overlapping end-to-end configuration and are attached to each other through the use of bolts 31 and nuts 33. A seal between each wall is also created by the placement of a seam sealant 44 to the outer edge 43 of each vertical seam. In the illustrated embodiment, each section of wall 32*a*, 32*b* is preferably fabricated from, but not limited to, 10, 12, 14, or 15 gauge high strength galvanized corrugated sheet steel that is around 25 to 57 inches high and 56 to 112.5 inches in length. Furthermore, each section of wall 32*a*, 32*b* may be formed to create a variety of dike apparatus 14 configurations, including round, oblong, or rectangular, as exemplified in FIGS. 1, 8, and 9. Note that although the curved wall portion illustrated in FIG. 9 is shown without any attached brace assemblies 34, in the illustrated embodiment such assemblies 34 are installed if the curve exceeds 78 feet.

FIGS. 3, 4, 5, 6, and 7 illustrate the brace assembly 34 in accordance with the illustrated embodiment of the present invention. Brace assemblies 34 are preferably positioned along the dike apparatus 14 in a manner so as to equally distribute any outward forces that may be exerted against the inner chamber 36 of the wall sections 32. The brace assembly 34 is comprised of a brace 52 that is operably mounted to a base plate 50. The base plate 50 in the illustrated embodiment includes an upper surface 90, a bottom surface 91, side extensions 92, a distal end 86, and a proximate end 88. In the illustrated embodiment, the brace 52 includes a body portion 51, lower flanges 80*a*, 80*b*, an upper flange 82, and a stiffening plate 84. The lower flanges 80*a*, 80*b* preferably rest upon the distal end 86 of the upper surface 90 of the base plate 50 and have at least one perforation that mates perforations in the base plate 50. These perforations are configured to permit the brace 52 to be bolted to the base plate 50 via at least one bolt 64, washer 65, and nut 66.

Each brace 52 is configured to provide vertical support to the wall sections 32. Furthermore, in the event of a leakage or the spilling of material from the primary storage vessel 12, the outwardly force exerted by the released materials against the inner chamber 36 portion of the wall sections 32 is transferred by the wall sections 32 to the braces 52. The braces 52 are configured to withstand such outwardly forces and to maintain minimal deflection in the wall sections 32. In the illustrated embodiment, the brace 52 includes a body portion 51 and stiffening plate 84 that are configured to assist the brace 52 in overcoming any outwardly forces that are exerted against the wall sections 32. The body portion 51 preferably has a generally triangular configuration. However, the body portion 51 can take on a number of different geometrical configurations, as would be appreciated by one skilled in the art. Attachment between the brace 52 and wall 32 may be achieved through the insertion of at least one bolt 74 into mating apertures in the upper flange 82 of the brace 52 and wall 32, the bolting engagement also preferably including a washer 75 and mating nut 76. Furthermore, each bolt head protruding inwardly from any wall 32 that may have contact with the liner 24 is preferably covered with tape so as to prevent the accidental tearing of the liner 24.

In instances where hazardous materials escape from the primary storage vessel 12, the outwardly force of the released material against the wall sections 32 creates a bending moment at the base of the dike apparatus 14. This moment is overcome via the base plate 50. The base plate 50 is preferably configured so that a substantial portion of the proximate end 88 of the base plate 50 is located within the region of the inner chamber 36 of the dike apparatus 14. Such a configuration utilizes the weight, and associated downward force, of released materials and containment system 10 components that are located above the portion of the base plate 50 that is positioned within the inner chamber 36 to resist said bending moment in order to prevent the brace assembly 34 and attached wall sections 32 from tipping outwardly, thereby supporting the wall sections 32 and maintaining the integrity of the dike apparatus 14.

The base plate 50 may also include side extensions 92 that are configured to provide the base plate 50 with traction against the adjacent ground 16. When the base plate 50 is subjected to lateral forces created by outwardly pressure that is exerted against the inner chamber 36 portion of the wall sections 32, the weight exerted down upon the base plate 50 is used by the lower portion 93 of the side extensions 92 to grip the ground 16, thereby providing traction to resist the lateral movement of said brace assemblies 34 and attached wall sections 32.

Figure 3:
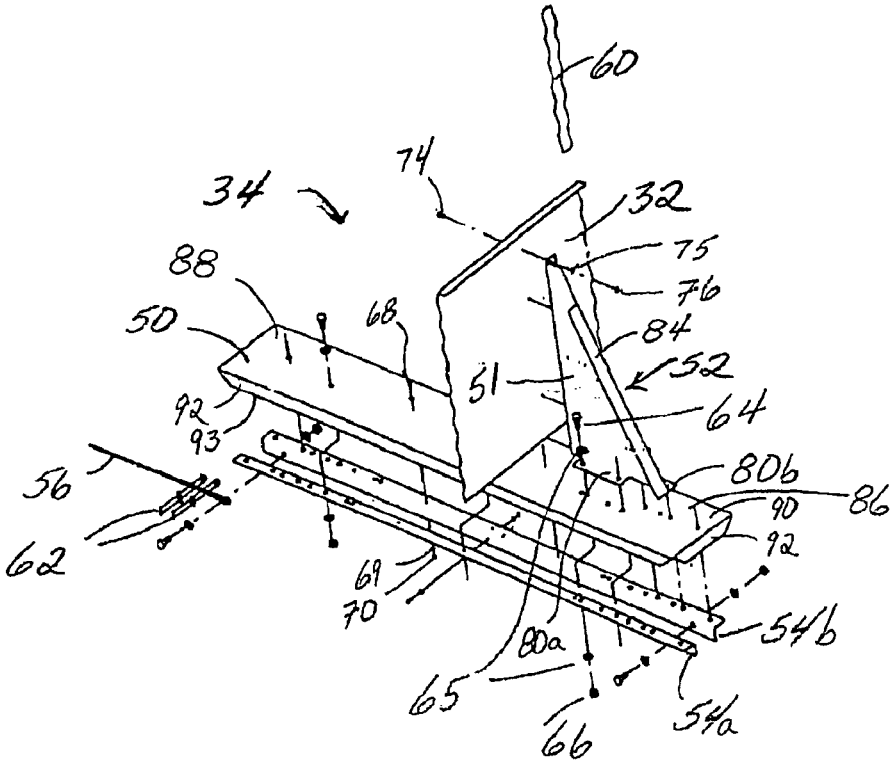
FIG. 3 is an exploded view of a brace assembly in accordance with the illustrated embodiment of the present invention.
Figure 4:
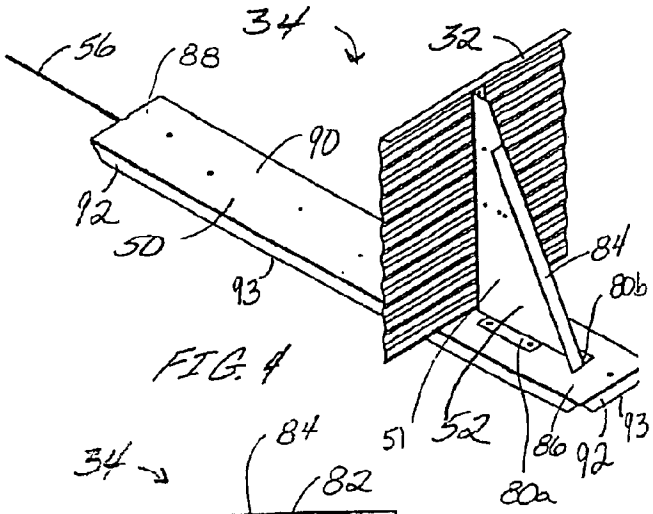
FIG. 4 is a perspective view of the brace assembly in accordance with the illustrated embodiment of the present invention.
Figure 5:
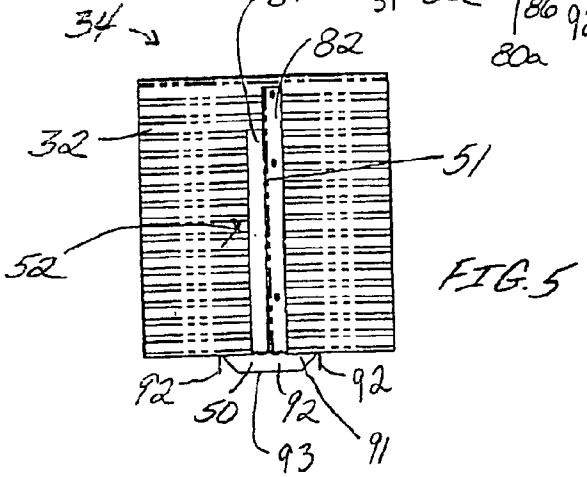
FIG. 5 is a rear elevated view of the brace assembly in accordance with the illustrated embodiment of the present invention.
Figure 6:
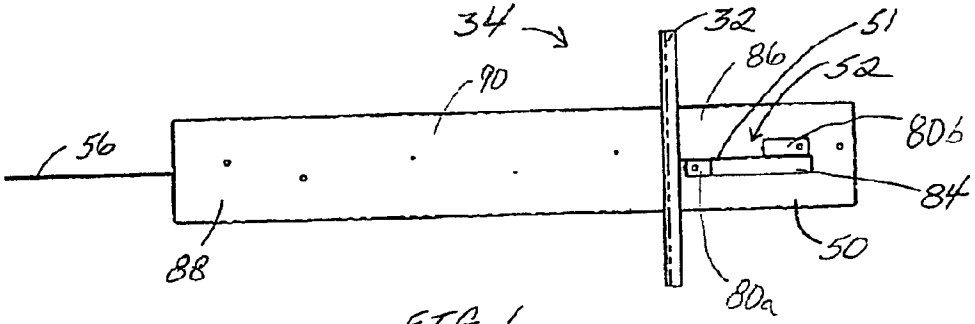
FIG. 6 is a top view of the brace assembly in accordance with the illustrated embodiment of the present invention.
Figure 7:
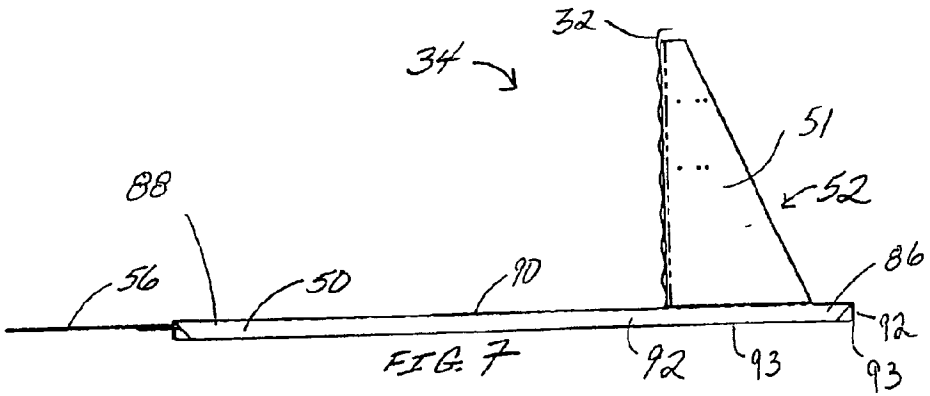
FIG. 7 is an elevated side view of the brace assembly in accordance with the illustrated embodiment of the present invention.

As shown in FIG. 3, the brace assembly 34 also preferably includes at least one base support channel 54*a*. In the illustrated embodiment, each base plate 50 is preferably attached to two base support channels 54*a*, 54*b*. Base support channels 54*a*, 54*b* are configured to provide additional stiffniess to the base plate 50 and to provide additional assistance in resisting the bending moment that may be exerted against the base of the dike apparatus 14. Each base support channel 54*a*, 54*b* preferably has a plurality of perforations configured and aligned to mate with a plurality of perforations in the base plate 50 so as to permit a bolting engagement between said base support channels 54*a*, 54*b* and the base plate 50. Each base support channel 54*a*, 54*b* further includes a plurality of perforations that are configured for the bolting engagement between said adjacent base support channels 54*a*, 54*b*, the bolting engagement including at least one bolt 64, a flat washer 65 on each side of the channel 54*a*, 54*b*, and a mating nut 66.

For stability purposes, in the illustrated embodiment, the support base channels 54*a*, 54*b* are preferably configured to be recessed into the base plate 50 and do not extend beyond the lower portion 93 of the side extensions 92 or the distal or proximate ends 86, 88. Such a configuration is intended to prevent the potential tipping of the dike apparatus 14, or its components, that may arise when uneven load distributions are transmitted to the brace assembly 34.

The incorporation of base support channels 54*a*, 54*b* in the illustrated embodiment of the present invention, and the associated stiffening created through their use, permits the base plate 50 to be fabricated from thinner material and thus have a lighter configuration than would be required in an embodiment that did not include the base support channels 54*a*, 54*b*. Decreasing material thickness not only reduces the material cost of the base plate 50, but also labor expenses associated with the handling, transportation, and installation of lighter materials are also typically reduced. However, in an alternative embodiment, the base plate 50 is configured to provide sufficient stiffness so as to eliminate the need for brace support channels 54*a*, 54*b*.

As an additional measure to prevent the outwardly tipping of the wall sections 32 and the brace assembly 34 when released materials from the primary storage vessel 12 exert pressure against the wall sections 32, and to resist any lateral movement of the brace assemblies 34 and attached wall sections 32, the brace assembly 34 in the illustrated embodiment may also incorporate at least one support cable 56, as illustrated in FIGS. 3, 4, 6, 7, 8, and 9. Support cables 56 are preferably constructed from galvanized steel and are attached to the base support channels 54*a*, 54*b* of each brace assembly 34 via at least one cable clamp 62. The support cable 56, which preferably has an loop at both a first end and a second end, is wrapped around a bolt, the bolt being secured to an assembled base channel 54*a*, 54*b*. However, in an alternative embodiment, the support cable 56 may be operably attached to the base plate 50 rather than the base support channels 54*a*, 54*b*.

As illustrated in FIGS. 8 and 9, the support cable 56 preferably is secured to, via a first brace clamp 62, and extends from, a first brace assembly 34*a* that is attached to a first wall 32*a*, and reaches across the inner chamber 36 to a second brace assembly 34*b* located at the opposing second wall 32*b*, whereupon the support cable 56 is preferably secured by a second cable clamp 62. Any slack in the support cable 56 extending across the inner chamber 36 is preferably removed so that when the support cable 56 is secured to the first and second brace assemblies 34*a*, 34*b*, the support cable 56 is taut. Tautness in the support cable 56 assists in the ability of the brace assemblies 34*a*, 34*b* to resist any outwardly forces that may be exerted against the walls 34*a*, 34*b* so as to prevent the walls from tipping or sliding outwardly.

While the invention has been described in connection with one or more embodiments, it will be understood that the invention is not limited to those embodiments. On the contrary, the invention includes all alternatives, modifications, and equivalents as may be included within the spirit and scope of the appended claims.

What is claimed is:

1. A dike apparatus for the secondary containment of released materials from a primary storage vessel to reduce the dangers associated with the exposure of harmful materials to the environment and living creatures, the dike apparatus comprising:

a. a plurality of wall sections, each wall section having a first vertical end and a second vertical end, the plurality of wall sections being operably connected to form an inner chamber;

b. at least one brace operably connected to at least one of the plurality of wall sections, the at least one brace configured to support at least a portion of the plurality of wall sections;

c. at least one base plate operably connected to the at least one brace, the at least one base plate having a distal end and a proximate end, a substantial portion of the proximate end being positioned within the region of the inner chamber; and d. a flexible liner, at least a portion of the flexible liner positioned within the inner chamber, the flexible liner being operably attached to at least a portion of the plurality of wall sections.

2. The apparatus of claim 1 further comprising at least one base support channel operably connected to at least a portion of the at least one base plate.

3. The apparatus of claim 2 further comprising at least one support cable, the at least one support cable being operably attached to the at least one base support channel.

4. The apparatus of claim 2 further comprising at least one support cable, the at least one support cable having a first end and a second end, the first end being operably connected to a first base support channel, the second end being operably connected to a second base support channel.

5. The apparatus of claim 1 further comprising at least one support cable, the at least one support cable being operably attached to the at least one base plate.

6. The apparatus of claim 1 wherein the at least one base plate includes at least one side extension, the at least one side extension configured to provide traction to the at least one base plate.

7. The apparatus of claim 1 wherein the at least one brace includes a stiffening plate, the stiffening plate configured to assist the at least one brace resist outwardly forces that are exerted against the inner chamber.

8. The apparatus of claim 1 wherein each wall section of the plurality of wall sections includes a first vertical end and a second vertical end, the first vertical end being substantially parallel to the second vertical end, the first vertical end being oriented to overlapped the second vertical end of an adjacent wall section.

9. A dike apparatus for the secondary containment of released materials from a primary storage vessel to reduce the dangers associated with the exposure of harmful materials to the environment and living creatures, the dike apparatus comprising:

a. a plurality of wall sections, each wall section having a first vertical end and a second vertical end, the plurality of wall sections being operably connected to form an inner chamber;

b. at least one brace operably connected to at least one of the plurality of wall sections, the at least one brace having a body portion, the body portion configured to resist outwardly forces exerted by the released materials against at least a portion of the plurality of wall sections;

c. at least one base plate operably connected to the at least one brace, the at least one base plate having a distal end, a proximate end, and at least one side extension, a substantial portion of the proximate end being positioned within the inner chamber, the at least one side extension configured to provide traction to the at least one base plate against lateral forces exerted by the released materials; and d. a flexible liner, at least a portion of the flexible liner positioned within the inner chamber, the flexible liner being operably attached to at least a portion of the plurality of wall sections.

10. The apparatus of claim 9 further comprising at least one base support channel connected to at least a portion of the at least one base plate.

11. The apparatus of claim 10 further comprising at least one support cable, the at least one support cable being operably attached to the at least one base support channel.

12. The apparatus of claim 10 further comprising at least one support cable, the at least one support cable having a first end and a second end, the first end being operably connected to a first base support channel, the second end being operably connected to a second base support channel.

13. The apparatus of claim 9 further comprising at least one support cable, the at least one support cable being operably attached to the at least one base plate.

14. The apparatus of claim 9 wherein the at least one base plate includes at least one side extension, the at least one side extension configured to provide traction to the at least one base plate.

15. The apparatus of claim 9 wherein the at least one brace includes a stiffening plate, the stiffening plate configured to assist the at least one brace resist outwardly forces that are exerted against the inner chamber.

16. A dike apparatus for the secondary containment of released materials from a primary storage vessel to reduce the dangers associated with the exposure of harmful materials to the environment and living creatures, the dike apparatus comprising:

a. a plurality of wall sections, each wall section having a first vertical end and a second vertical end, the first vertical end being substantially parallel to the second vertical end, the first vertical end being oriented to overlapped the second vertical end of an adjacent wall section, the overlapping arrangement of the plurality of wall sections being operably connected to form an inner chamber;

b. at least one brace, the at least one brace having a body portion, a stiffening plate, an upper flange, and a lower flange, the upper flange operably connected to a portion of the plurality of wall sections;

c. at least one base plate, the at least one base plate having an upper surface, a bottom surface, a distal end, a proximate end, and at least one side extension, the upper surface being operably connected to the lower flange, the at least one side extension configured to provide traction to the base plate against lateral forces exerted by the released material;

d. at least one base support channel, the at least one base support channel operably connected to at least a portion of the bottom surface of the at least one base plate;

e. at least one support cable, the at least one support cable being operably attached to at least one of the at least one base support channel; and f. a flexible liner, at least a portion of the flexible liner positioned within the inner chamber, the flexible liner being operably attached to at least a portion of the plurality of wall sections.

17. The apparatus of claim 16 wherein the at least one support cable includes a first end and a second end, the first end being operably connected to a first base support channel, the second end being operably connected to a second base support channel.

18. The apparatus of claim 16 further comprising a pad constructed from a geotextile material, the pad configured for insertion into the inner chamber, the pad being operably connected to at least a portion of the plurality of wall sections.

19. A method for constructing a secondary containment dike apparatus for the containment of released materials from a primary storage vessel to reduce the dangers associated with the exposure of harmful materials to the environment and living creatures comprising:

a. connecting a plurality of wall sections to form an inner chamber;

b. securing the plurality of wall sections to at least one brace, the at least one brace having a body portion, the body portion configured to support the plurality walls and to resist outwardly forces exerted against at least a portion of the plurality of wall sections by the released material;

c. mounting the at least one brace to at least one base plate, the at least one base plate having an upper surface, a bottom surface, a proximate end, and a distal end, the distal end being positioned within the inner chamber; and d. inserting a flexible material into at least a portion of the inner chamber, the flexible material configured to prevent the passage of the released material therethrough.

20. The method of claim 19 further comprising attaching at least one base support channel to the at least one base plate.

21. The method of claim 20 further comprising securing at least one base support cable to at least one of the at least one base support channel.

22. The method of claim 19 further comprising securing at least one support cable to at least one of the at least one base plate.

23. The method of claim 19 further comprising covering at least a portion of the flexible material in the inner chamber with a solid material.

* * * * *